US009767673B1

(12) United States Patent
Clip

(10) Patent No.: US 9,767,673 B1
(45) Date of Patent: Sep. 19, 2017

(54) SYSTEM AND METHOD FOR DETECTING THAT AN OPEN BAG IS BEING CARRIED

(71) Applicant: Paul Clip, Walnut Creek, CA (US)

(72) Inventor: Paul Clip, Walnut Creek, CA (US)

( * ) Notice: Subject to any disclaimer, the term of this patent is extended or adjusted under 35 U.S.C. 154(b) by 0 days.

(21) Appl. No.: 15/175,846

(22) Filed: Jun. 7, 2016

(51) Int. Cl.
*G08B 21/00* (2006.01)
*G08B 21/24* (2006.01)

(52) U.S. Cl.
CPC ..... *G08B 21/24* (2013.01)

(58) Field of Classification Search
CPC .... G08B 21/00; G08B 21/24; G08B 13/1445; A45C 13/18
USPC ..... 340/686.1, 571, 568.7, 665, 666, 542, 340/543
See application file for complete search history.

(56) References Cited

U.S. PATENT DOCUMENTS

| | | | |
|---|---|---|---|
| 853,566 | A | 5/1907 | Sparks |
| 2,416,783 | A | 3/1947 | Vallieres |
| 2,517,178 | A | 8/1950 | Cheatham |
| 2,538,616 | A | 1/1951 | Cross |
| 2,718,943 | A | 9/1955 | Braverman |
| 3,606,372 | A | 9/1971 | Browning |
| 3,814,220 | A | 6/1974 | Brody |
| 4,146,045 | A | 3/1979 | Grant |
| 4,160,496 | A | 7/1979 | Knight |
| 4,221,402 | A | 9/1980 | Kazmark |
| 4,538,709 | A | 9/1985 | Williams et al. |
| 4,588,056 | A | 5/1986 | Bernbaum |
| 4,795,186 | A | 1/1989 | Tyus |
| 5,148,150 | A * | 9/1992 | White ..... G08B 13/1436 200/61.52 |
| 5,265,307 | A | 11/1993 | Hull et al. |
| 5,375,685 | A | 12/1994 | Plath |
| 5,407,405 | A | 4/1995 | Oren |

(Continued)

FOREIGN PATENT DOCUMENTS

| | | | |
|---|---|---|---|
| DE | 202009010549 | U1 | 10/2009 |
| WO | 0152687 | A | 7/2001 |

(Continued)

OTHER PUBLICATIONS

Search Report and Written Opinion dated Aug. 31, 2016 from International Serial No. PCT/US2016/036485 filed Jun. 8, 2016.

(Continued)

*Primary Examiner* — Tai T Nguyen
(74) *Attorney, Agent, or Firm* — Law Office of Ilya Libenzon

(57) ABSTRACT

A system for detecting that an open bag is being carried includes a portable container having a first compartment with a first opening, the first opening mutable between an open state and a closed state, at least one first sensor incorporated in the portable container, the at least one first sensor configured to detect that the first opening is in the open state, at least one second sensor incorporated in the portable container, the at least one second sensor configured to detect that the portable container is being carried, and a control circuit coupled to the at least one first sensor and at least one second sensor, the control circuit configured to transmit an alert to a user when the at least one first sensor detects that the first opening is in the open state and the at least one second sensor detects that the portable container is being carried.

18 Claims, 9 Drawing Sheets

(56) References Cited

U.S. PATENT DOCUMENTS 5,433,303 A 7/1995 Chen
5,464,080 A 11/1995 Liang
5,564,538 A 10/1996 Sadow
5,661,456 A * 8/1997 Staehle, Jr. ..... G08B 21/0297 340/5.54
5,699,886 A 12/1997 Latshaw
5,806,143 A 9/1998 Tsai
5,904,230 A 5/1999 Peterson
5,924,533 A 7/1999 Cnockaert et al.
6,024,264 A 2/2000 Java
6,105,508 A 8/2000 Ryburg
6,213,265 B1 4/2001 Wang
6,279,706 B1 8/2001 Mao
6,357,080 B1 3/2002 Tsai
6,380,856 B1 * 4/2002 Johnson ..... A45C 13/24 340/568.7
6,470,533 B1 10/2002 Comstock
6,540,134 B1 4/2003 Rasche
6,543,796 B1 4/2003 Johnson et al.
6,564,426 B1 5/2003 Wang
6,776,300 B2 8/2004 Walsh et al.
6,898,823 B2 5/2005 Tsai
6,918,514 B2 7/2005 Petit
7,274,292 B2 9/2007 Velhal et al.
7,328,796 B2 2/2008 Brunson et al.
7,445,216 B1 11/2008 Chou
7,451,861 B2 11/2008 Bhavnani
7,453,357 B2 11/2008 Bernal-Silva et al.
7,617,956 B1 11/2009 Sabbah
7,696,887 B1 4/2010 Echavarria
7,832,532 B2 11/2010 Nykoluk et al.
7,845,508 B2 12/2010 Rothschild et al.
7,987,955 B2 8/2011 Puchalski
8,253,560 B2 8/2012 Howard et al.
8,317,558 B2 11/2012 Bucknell et al.
8,613,349 B1 12/2013 Halko et al.
8,662,267 B1 3/2014 Hart et al.
8,869,960 B2 10/2014 Mangano
8,964,037 B2 2/2015 Petricoin
9,277,796 B1 3/2016 Elam
2002/0056736 A1 5/2002 Conte
2002/0084159 A1 7/2002 Hamlin
2002/0096410 A1 7/2002 Nykoluk
2003/0034887 A1 2/2003 Crabtree et al.
2003/0102195 A1 6/2003 Mittleman et al.
2003/0122671 A1 7/2003 Jespersen
2003/0132079 A1 7/2003 Bellini
2004/0104820 A1 * 6/2004 Sosna ..... G08B 25/016 340/686.1
2004/0108345 A1 6/2004 Oh
2004/0181906 A1 9/2004 Kuo et al.
2004/0238304 A1 12/2004 Fisher
2005/0011043 A1 1/2005 Comstock
2005/0015932 A1 1/2005 Tsai
2005/0016809 A1 1/2005 Wu
2005/0082131 A1 4/2005 Fenton et al.
2005/0098402 A1 5/2005 Cohen
2005/0183914 A1 8/2005 Lin
2006/0037825 A1 2/2006 Dayton et al.
2006/0076203 A1 4/2006 Miller
2006/0118376 A1 6/2006 Godshaw et al.
2006/0272126 A1 12/2006 Burgess et al.
2007/0007801 A1 1/2007 Bishop
2007/0012593 A1 1/2007 Kitchens et al.
2007/0052534 A1 3/2007 Bird et al.
2007/0089952 A1 4/2007 Herbst et al.
2007/0164064 A1 7/2007 Nathan
2008/0062120 A1 3/2008 Wheeler et al.
2008/0078790 A1 4/2008 Bolling
2008/0136642 A1 6/2008 Wise
2010/0051633 A1 3/2010 Porte et al.
2010/0089778 A1 4/2010 Park
2010/0282556 A1 11/2010 Tseng et al.
2010/0313383 A1 12/2010 Lai
2011/0132708 A1 6/2011 DeLine et al.
2011/0209960 A1 9/2011 MacLean et al.
2012/0217109 A1 8/2012 King et al.
2012/0273314 A1 11/2012 Raymond et al.
2012/0325607 A1 12/2012 Webster et al.
2013/0032443 A1 2/2013 Soedomo
2013/0057694 A1 * 3/2013 Petricoin, Jr. ..... H04N 7/18 348/155
2013/0075213 A1 3/2013 Chen et al.
2013/0075214 A1 3/2013 Chen et al.
2013/0098410 A1 4/2013 Prasannakumar et al.
2013/0153351 A1 6/2013 House
2013/0175130 A1 7/2013 Liang
2013/0233362 A1 9/2013 Miller-Klerer
2013/0264160 A1 10/2013 Mediamolle
2014/0151172 A1 6/2014 Diaz
2014/0173439 A1 6/2014 Gutierrez et al.
2014/0238799 A1 8/2014 Sharma
2014/0299428 A1 10/2014 Gadbois
2014/0370917 A1 12/2014 Buchheim et al.
2015/0015394 A1 1/2015 Hansen et al.
2015/0047939 A1 2/2015 Chang
2015/0126234 A1 5/2015 Rodriguez
2015/0272291 A1 10/2015 Sener et al.
2015/0308406 A1 * 10/2015 Li ..... F03D 80/20 290/44
2015/0348347 A1 12/2015 Diz et al.
2016/0113388 A1 4/2016 Distefano

FOREIGN PATENT DOCUMENTS

WO 2009027992 A2 3/2009
WO 2009039154 A1 3/2009
WO 2013080236 A1 6/2013

OTHER PUBLICATIONS

Search Report and Written Opinion dated Aug. 31, 2016 from International Serial No. PCT/US2016/036494 filed Jun. 8, 2016.
Search Report and Written Opinion dated May 13, 2016 from International Serial No. PCT/US2016/017464 filed Feb. 11, 2016.
Search Report and Written Opinion dated May 13, 2016 from International Serial No. PCT/US2016/017470 filed Feb. 11, 2016.
Search Report and Written Opinion dated May 13, 2016 from International Serial No. PCT/US2016/017475 filed Feb. 11, 2016.
Search Report and Written Opinion dated May 19, 2016 from International Serial No. PCT/US2016/017447 filed Feb. 11, 2016.

* cited by examiner

SYSTEM AND METHOD FOR DETECTING THAT AN OPEN BAG IS BEING CARRIED

TECHNICAL FIELD

This invention relates to property security devices. More particularly, the present invention relates to a system to detect whether a user is carrying an open portable container.

BACKGROUND ART

It is fairly common for people to carry personal belongings and other goods around in backpacks, satchels, handbags, or other portable containers. Typically, the portable containers have some sort of bag, box, or wrap form, and can be closed so that the contents are more or less entirely concealed within the interior of the portable container. Often, the portable container may be so secured with a zipper or similar fastener. A drawback of this system is that when users forget to fasten their portable container closed, objects may fall out or be more easily stolen. As it is easy to forget to secure one's backpack or handbag, this is a common problem.

In view of the above, there is a need for a way to alert users that they have left portable containers opened as they carry them.

SUMMARY

In one aspect, a system for detecting that an open bag is being carried includes a portable container having a first compartment with a first opening, the first opening mutable between an open state and a closed state. The system includes at least one first sensor incorporated in the portable container, the at least one first sensor configured to detect that the first opening is in the open state. The system includes at least one second sensor incorporated in the portable container, the at least one second sensor configured to detect that the portable container is being carried. The system includes a control circuit coupled to the at least one first sensor and at least one second sensor, the control circuit configured to transmit an alert to a user when the at least one first sensor detects that the first opening is in the open state and the at least one second sensor detects that the portable container is being carried.

In a related embodiment, the at least one first sensor also includes a light sensor disposed within the first compartment. In another embodiment, the light sensor is disposed adjacent to the first opening. In an additional embodiment, the portable container further includes a second compartment. In another embodiment, the at least one first sensor also includes a light sensor deployed within the second compartment. A further embodiment also includes a window that permits light that enters the second compartment to enter the first compartment. In a further embodiment, the at least one first sensor also includes at least one proximity sensor mounted on an edge of the opening, the at least one proximity sensor configured to detect proximity of the sensor to an opposite edge of the opening. In an additional embodiment, the at least one first sensor further includes an audio emitter and receiver pair deployed within the first compartment. In yet another embodiment, the at least one second sensor also includes a light sensor. In a further embodiment still, the light sensor is mounted on an exterior surface of the portable container that is typically covered when the portable container is being carried. In still another embodiment, the exterior surface is an underside of a strap.

In an additional embodiment, the at least one second sensor further includes a motion sensor. In another embodiment, the control circuit also includes a processor. In a further embodiment, the control circuit is electrically coupled to at least one of the at least one first sensor and the at least one second sensor. In still another embodiment, the control circuit is coupled to at least one of the at least one first sensor and the at least one second sensor by a transmitter-receiver pair. Yet another embodiment further includes at least one signaling device coupled to the control circuit. A further embodiment still includes a transceiver coupled to the control circuit, the transceiver configured to convey the alert to a computing device.

In another aspect, a method for reminding a user to close a bag includes detecting, by a first sensor incorporated in a portable container having an opening, the opening mutable between an open state and a closed state, that the opening is in the open state. The method includes detecting, by a second sensor incorporated in the portable container, that the portable container is being carried. The method includes alerting a user, by a control circuit coupled to the first sensor and the second sensor.

In a related embodiment, alerting further includes transmitting, to a mobile device used by the user, a message.

Other aspects, embodiments and features of the disclosed system and method will become apparent from the following detailed description of the invention when considered in conjunction with the accompanying figures. The accompanying figures are for schematic purposes and are not intended to be drawn to scale. In the figures, each identical or substantially similar component that is illustrated in various figures is represented by a single numeral or notation at its initial drawing depiction. For purposes of clarity, not every component is labeled in every figure. Nor is every component of each embodiment of the system and method is shown where illustration is not necessary to allow those of ordinary skill in the art to understand the device and method.

BRIEF DESCRIPTION OF THE DRAWINGS

The preceding summary, as well as the following detailed description of the disclosed system and method, will be better understood when read in conjunction with the attached drawings. For the purpose of illustrating the system and method, presently preferred embodiments are shown in the drawings. It should be understood, however, that neither the system nor the method is limited to the precise arrangements and instrumentalities shown.

DETAILED DESCRIPTION OF SPECIFIC EMBODIMENTS

Figure 1A:
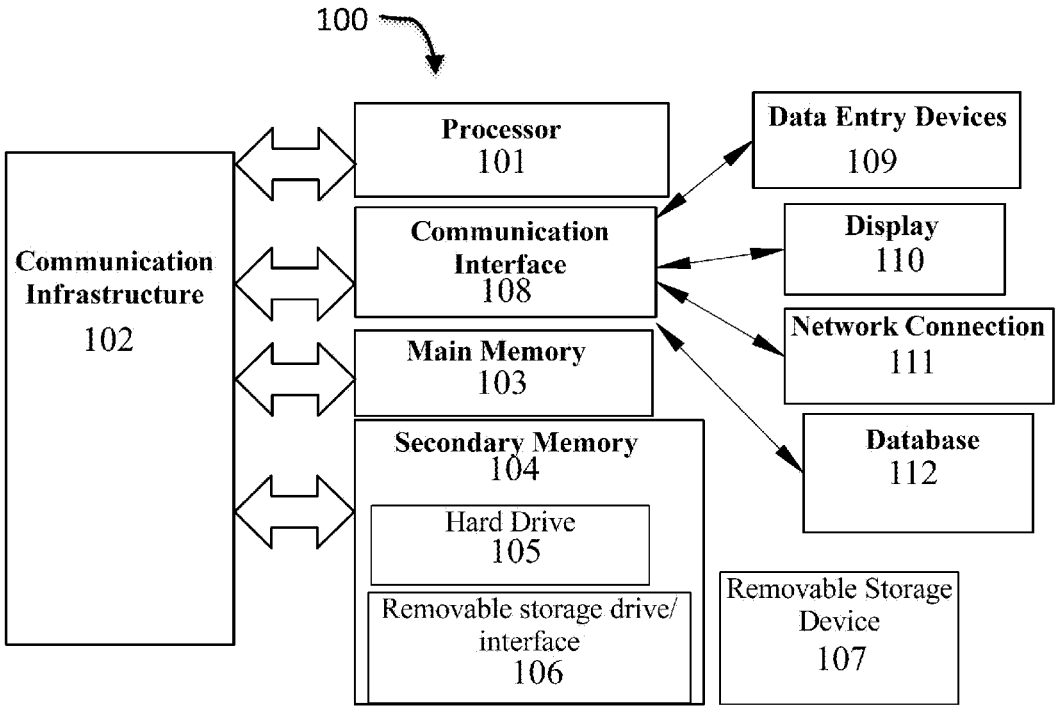
FIG. 1A is a block diagram depicting an example of an computing device as described herein.

Some embodiments of the disclosed system and methods will be better understood by reference to the following comments concerning computing devices. A "computing device" may be defined as including personal computers, laptops, tablets, smart phones, and any other computing device capable of supporting an application as described herein. The system and method disclosed herein will be better understood in light of the following observations concerning the computing devices that support the disclosed application, and concerning the nature of web applications in general. An exemplary computing device is illustrated by FIG. 1A. The processor 101 may be a special purpose or a general-purpose processor device. As will be appreciated by persons skilled in the relevant art, the processor device 101 may also be a single processor in a multi-core/multiprocessor system, such system operating alone, or in a cluster of computing devices operating in a cluster or server farm. The processor 101 is connected to a communication infrastructure 102, for example, a bus, message queue, network, or multi-core message-passing scheme.

The computing device also includes a main memory 103, such as random access memory (RAM), and may also include a secondary memory 104. Secondary memory 104 may include, for example, a hard disk drive 105, a removable storage drive or interface 106, connected to a removable storage unit 107, or other similar means. As will be appreciated by persons skilled in the relevant art, a removable storage unit 107 includes a computer usable storage medium having stored therein computer software and/or data. Examples of additional means creating secondary memory 104 may include a program cartridge and cartridge interface (such as that found in video game devices), a removable memory chip (such as an EPROM, or PROM) and associated socket, and other removable storage units 107 and interfaces 106 which allow software and data to be transferred from the removable storage unit 107 to the computer system. In some embodiments, to "maintain" data in the memory of a computing device means to store that data in that memory in a form convenient for retrieval as required by the algorithm at issue, and to retrieve, update, or delete the data as needed.

The computing device may also include a communications interface 108. The communications interface 108 allows software and data to be transferred between the computing device and external devices. The communications interface 108 may include a modem, a network interface (such as an Ethernet card), a communications port, a PCMCIA slot and card, or other means to couple the computing device to external devices. Software and data transferred via the communications interface 108 may be in the form of signals, which may be electronic, electromagnetic, optical, or other signals capable of being received by the communications interface 108. These signals may be provided to the communications interface 108 via wire or cable, fiber optics, a phone line, a cellular phone link, and radio frequency link or other communications channels. Other devices may be coupled to the computing device 100 via the communications interface 108. In some embodiments, a device or component is "coupled" to a computing device 100 if it is so related to that device that the product or means and the device may be operated together as one machine. In particular, a piece of electronic equipment is coupled to a computing device if it is incorporated in the computing device (e.g. a built-in camera on a smart phone), attached to the device by wires capable of propagating signals between the equipment and the device (e.g. a mouse connected to a personal computer by means of a wire plugged into one of the computer's ports), tethered to the device by wireless technology that replaces the ability of wires to propagate signals (e.g. a wireless BLUETOOTH® headset for a mobile phone), or related to the computing device by shared membership in some network consisting of wireless and wired connections between multiple machines (e.g. a printer in an office that prints documents to computers belonging to that office, no matter where they are, so long as they and the printer can connect to the internet). A computing device 100 may be coupled to a second computing device (not shown); for instance, a server may be coupled to a client device, as described below in greater detail.

The communications interface in the system embodiments discussed herein facilitates the coupling of the computing device with data entry devices 109, the device's display 110, and network connections, whether wired or wireless 111. In some embodiments, "data entry devices" 109 are any equipment coupled to a computing device that may be used to enter data into that device. This definition includes, without limitation, keyboards, computer mice, touchscreens, digital cameras, digital video cameras, wireless antennas, Global Positioning System devices, audio input and output devices, gyroscopic orientation sensors, proximity sensors, compasses, scanners, specialized reading devices such as fingerprint or retinal scanners, and any hardware device capable of sensing electromagnetic radiation, electromagnetic fields, gravitational force, electromagnetic force, temperature, vibration, or pressure. A computing device's "manual data entry devices" is the set of all data entry devices coupled to the computing device that permit the user to enter data into the computing device using manual manipulation. Manual entry devices include without limitation keyboards, keypads, touchscreens, track-pads, computer mice, buttons, and other similar components. A computing device may also possess a navigation facility. The computing device's "navigation facility" may be any facility coupled to the computing device that enables the device accurately to calculate the device's location on the surface of the Earth. Navigation facilities can include a receiver configured to communicate with the Global Positioning System or with similar satellite networks, as well as any other system that mobile phones or other devices use to ascertain their location, for example by communicating with cell towers. In some embodiments, a computing device's "display" 109 is a device coupled to the computing device, by means of which the computing device can display images. Display include without limitation monitors, screens, television devices, and projectors.

Computer programs (also called computer control logic) are stored in main memory 103 and/or secondary memory 104. Computer programs may also be received via the communications interface 108. Such computer programs, when executed, enable the processor device 101 to implement the system embodiments discussed below. Accordingly, such computer programs represent controllers of the system. Where embodiments are implemented using software, the software may be stored in a computer program product and loaded into the computing device using a removable storage drive or interface 106, a hard disk drive 105, or a communications interface 108.

The computing device may also store data in database 112 accessible to the device. A database 112 is any structured collection of data. As used herein, databases can include "NoSQL" data stores, which store data in a few key-value structures such as arrays for rapid retrieval using a known set of keys (e.g. array indices). Another possibility is a relational database, which can divide the data stored into fields representing useful categories of data. As a result, a stored data record can be quickly retrieved using any known portion of the data that has been stored in that record by searching within that known datum's category within the database 112, and can be accessed by more complex queries, using languages such as Structured Query Language, which retrieve data based on limiting values passed as parameters and relationships between the data being retrieved. More specialized queries, such as image matching queries, may also be used to search some databases. A database can be created in any digital memory.

Persons skilled in the relevant art will also be aware that while any computing device must necessarily include facilities to perform the functions of a processor 101, a communication infrastructure 102, at least a main memory 103, and usually a communications interface 108, not all devices will necessarily house these facilities separately. For instance, in some forms of computing devices as defined above, processing 101 and memory 103 could be distributed through the same hardware device, as in a neural net, and thus the communications infrastructure 102 could be a property of the configuration of that particular hardware device. Many devices do practice a physical division of tasks as set forth above, however, and practitioners skilled in the art will understand the conceptual separation of tasks as applicable even where physical components are merged.

The computing device 100 may employ one or more security measures to protect the computing device 100 or its data. For instance, the computing device 100 may protect data using a cryptographic system. In one embodiment, a cryptographic system is a system that converts data from a first form, known as "plaintext," which is intelligible when viewed in its intended format, into a second form, known as "cyphertext," which is not intelligible when viewed in the same way. The cyphertext is may be unintelligible in any format unless first converted back to plaintext. In one embodiment, the process of converting plaintext into cyphertext is known as "encryption." The encryption process may involve the use of a datum, known as an "encryption key," to alter the plaintext. The cryptographic system may also convert cyphertext back into plaintext, which is a process known as "decryption." The decryption process may involve the use of a datum, known as a "decryption key," to return the cyphertext to its original plaintext form. In embodiments of cryptographic systems that are "symmetric," the decryption key is essentially the same as the encryption key: possession of either key makes it possible to deduce the other key quickly without further secret knowledge. The encryption and decryption keys in symmetric cryptographic systems may be kept secret, and shared only with persons or entities that the user of the cryptographic system wishes to be able to decrypt the cyphertext. One example of a symmetric cryptographic system is the Advanced Encryption Standard ("AES"), which arranges plaintext into matrices and then modifies the matrices through repeated permutations and arithmetic operations with an encryption key.

In embodiments of cryptographic systems that are "asymmetric," either the encryption or decryption key cannot be readily deduced without additional secret knowledge, even given the possession of the corresponding decryption or encryption key, respectively; a common example is a "public key cryptographic system," in which possession of the encryption key does not make it practically feasible to deduce the decryption key, so that the encryption key may safely be made available to the public. An example of a public key cryptographic system is RSA, in which the encryption key involves the use of numbers that are products of very large prime numbers, but the decryption key involves the use of those very large prime numbers, such that deducing the decryption key from the encryption key requires the practically infeasible task of computing the prime factors of a number which is the product of two very large prime numbers. Another example is elliptic curve cryptography, which relies on the fact that given two points P and Q on an elliptic curve over a finite field, and a definition for addition where A+B=R, the point where a line connecting point A and point B intersects the elliptic curve, where "0," the identity, is a point at infinity in a projective plane containing the elliptic curve, finding a number k such that adding P to itself k times results in Q is computationally impractical, given correctly selected elliptic curve, finite field, and P and Q.

The systems may be deployed in a number of ways, including on a stand-alone computing device, a set of computing devices working together in a network, or a web application. Persons of ordinary skill in the art will recognize a web application as a particular kind of computer program system designed to function across a network, such as the Internet. A schematic illustration of a web application platform is provided in FIG. 1A. Web application platforms typically include at least one client device 120, which is an computing device as described above. The client device 120 connects via some form of network connection to a network 121, such as the Internet. The network 121 may be any arrangement that links together computing devices 120, 122, and includes without limitation local and international wired networks including telephone, cable, and fiber-optic networks, wireless networks that exchange information using signals of electromagnetic radiation, including cellular communication and data networks, and any combination of those wired and wireless networks. Also connected to the network 121 is at least one server 122, which is also an computing device as described above, or a set of computing devices that communicate with each other and work in concert by local or network connections. Of course, practitioners of ordinary skill in the relevant art will recognize that a web application can, and typically does, run on several servers 122 and a vast and continuously changing population of client devices 120. Computer programs on both the client device 120 and the server 122 configure both devices to perform the functions required of the web application 123. Web applications 123 can be designed so that the bulk of their processing tasks are accomplished by the server 122, as configured to perform those tasks by its web application program, or alternatively by the client device 120. Some web applications 123 are designed so that the client device 120 solely displays content that is sent to it by the server 122, and the server 122 performs all of the processing, business logic, and data storage tasks. Such "thin client" web applications are sometimes referred to as "cloud" applications, because essentially all computing tasks are performed by a set of servers 122 and data centers visible to the client only as a single opaque entity, often represented on diagrams as a cloud.

Many computing devices, as defined herein, come equipped with a specialized program, known as a web browser, which enables them to act as a client device 120 at least for the purposes of receiving and displaying data output by the server 122 without any additional programming. Web browsers can also act as a platform to run so much of a web application as is being performed by the client device 120, and it is a common practice to write the portion of a web application calculated to run on the client device 120 to be operated entirely by a web browser. Such browser-executed programs are referred to herein as "client-side programs," and frequently are loaded onto the browser from the server 122 at the same time as the other content the server 122 sends to the browser. However, it is also possible to write programs that do not run on web browsers but still cause an computing device to operate as a web application client 120. Thus, as a general matter, web applications 123 require some computer program configuration of both the client device (or devices) 120 and the server 122. The computer program that comprises the web application component on either computing device's system FIG. 1A configures that device's processor 200 to perform the portion of the overall web application's functions that the programmer chooses to assign to that device. Persons of ordinary skill in the art will appreciate that the programming tasks assigned to one device may overlap with those assigned to another, in the interests of robustness, flexibility, or performance. Furthermore, although the best known example of a web application as used herein uses the kind of hypertext markup language protocol popularized by the World Wide Web, practitioners of ordinary skill in the art will be aware of other network communication protocols, such as File Transfer Protocol, that also support web applications as defined herein.

The one or more client devices 120 and the one or more servers 122 may communicate using any protocol according to which data may be transmitted from the client 120 to the server 122 and vice versa. As a non-limiting example, the client 120 and server 122 may exchange data using the Internet protocol suite, which includes the transfer control protocol (TCP) and the Internet Protocol (IP), and is sometimes referred to as TCP/IP. In some embodiments, the client and server 122 encrypt data prior to exchanging the data, using a cryptographic system as described above. In one embodiment, the client 120 and server 122 exchange the data using public key cryptography; for instance, the client and the server 122 may each generate a public and private key, exchange public keys, and encrypt the data using each others' public keys while decrypting it using each others' private keys.

In some embodiments, the client 120 authenticates the server 122 or vice-versa using digital certificates. In one embodiment, a digital certificate is a file that conveys information and links the conveyed information to a "certificate authority" that is the issuer of a public key in a public key cryptographic system. The certificate in some embodiments contains data conveying the certificate authority's authorization for the recipient to perform a task. The authorization may be the authorization to access a given datum. The authorization may be the authorization to access a given process. In some embodiments, the certificate may identify the certificate authority.

The linking may be performed by the formation of a digital signature. In one embodiment, a digital signature is an encrypted a mathematical representation of a file using the private key of a public key cryptographic system. The signature may be verified by decrypting the encrypted mathematical representation using the corresponding public key and comparing the decrypted representation to a purported match that was not encrypted; if the signature protocol is well-designed and implemented correctly, this means the ability to create the digital signature is equivalent to possession of the private decryption key. Likewise, if the mathematical representation of the file is well-designed and implemented correctly, any alteration of the file will result in a mismatch with the digital signature; the mathematical representation may be produced using an alteration-sensitive, reliably reproducible algorithm, such as a hashing algorithm. A mathematical representation to which the signature may be compared may be included with the signature, for verification purposes; in other embodiments, the algorithm used to produce the mathematical representation is publically available, permitting the easy reproduction of the mathematical representation corresponding to any file. In some embodiments, a third party known as a certificate authority is available to verify that the possessor of the private key is a particular entity; thus, if the certificate authority may be trusted, and the private key has not been stolen, the ability of a entity to produce a digital signature confirms the identity of the entity, and links the file to the entity in a verifiable way. The digital signature may be incorporated in a digital certificate, which is a document authenticating the entity possessing the private key by authority of the issuing certificate authority, and signed with a digital signature created with that private key and a mathematical representation of the remainder of the certificate. In other embodiments, the digital signature is verified by comparing the digital signature to one known to have been created by the entity that purportedly signed the digital signature; for instance, if the public key that decrypts the known signature also decrypts the digital signature, the digital signature may be considered verified. The digital signature may also be used to verify that the file has not been altered since the formation of the digital signature.

The server 122 and client 120 may communicate using a security combining public key encryption, private key encryption, and digital certificates. For instance, the client 120 may authenticate the server 122 using a digital certificate provided by the server 122. The server 122 may authenticate the client 120 using a digital certificate provided by the client 120. After successful authentication, the device that received the digital certificate possesses a public key that corresponds to the private key of the device providing the digital certificate; the device that performed the authentication may then use the public key to convey a secret to the device that issued the certificate. The secret may be used as the basis to set up private key cryptographic communication between the client 120 and the server 122; for instance, the secret may be a private key for a private key cryptographic system. The secret may be a datum from which the private key may be derived. The client 120 and server 122 may then uses that private key cryptographic system to exchange information until the in which they are communicating ends. In some embodiments, this handshake and secure communication protocol is implemented using the secure sockets layer (SSL) protocol. In other embodiments, the protocol is implemented using the transport layer security (TLS) protocol. The server 122 and client 120 may communicate using hyper-text transfer protocol secure (HTTPS).

Embodiments of the disclosed system and method warn users if they are carrying an opened portable container. A user who leaves his or her backpack unzipped and begins to carry it away may be alerted by the system; the alert may be a visible or audible signal, or may be transmitted to the user's mobile device.

Figure 2A:
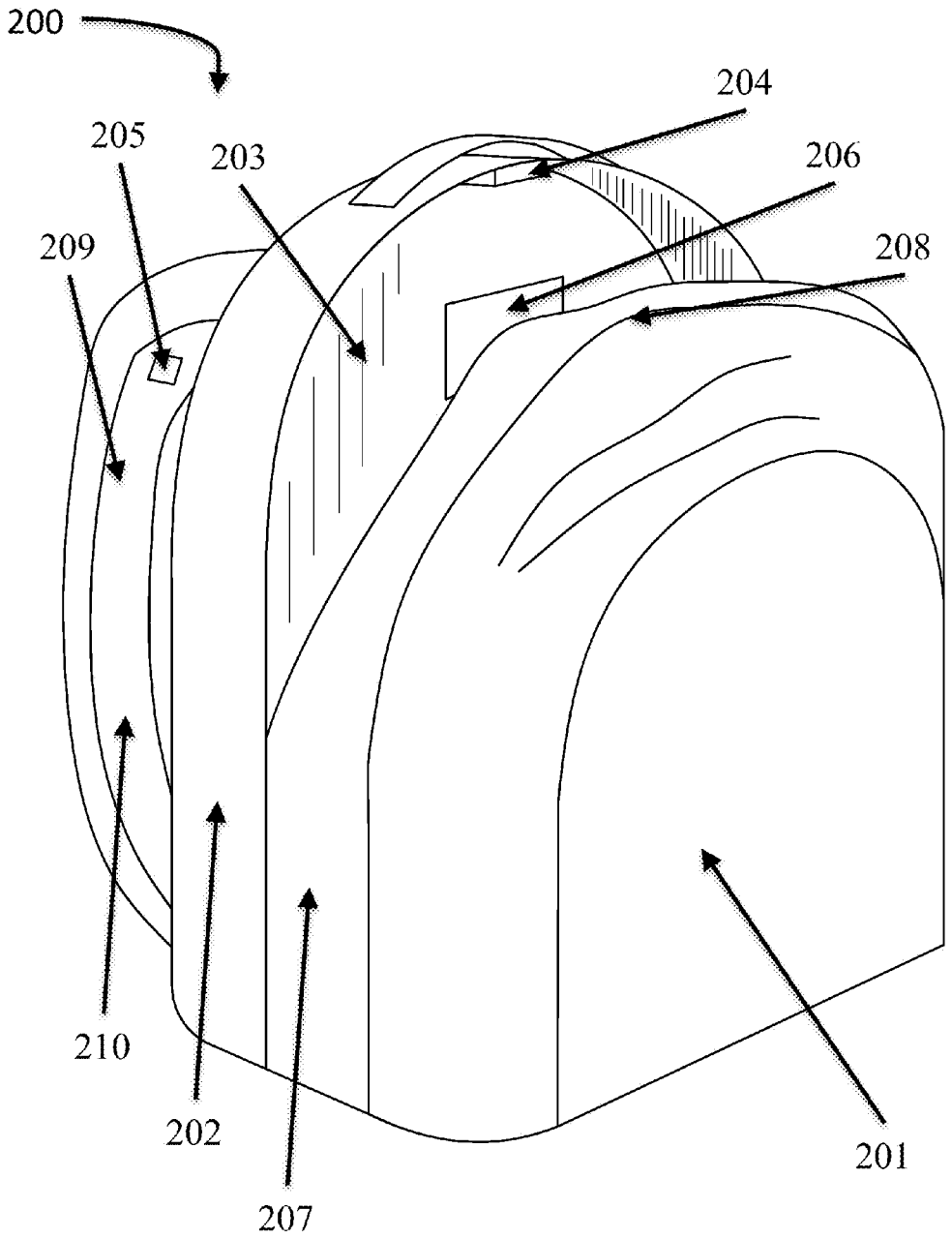
FIG. 2A is a schematic diagram of an embodiment of the disclosed system.
Figure 2B:
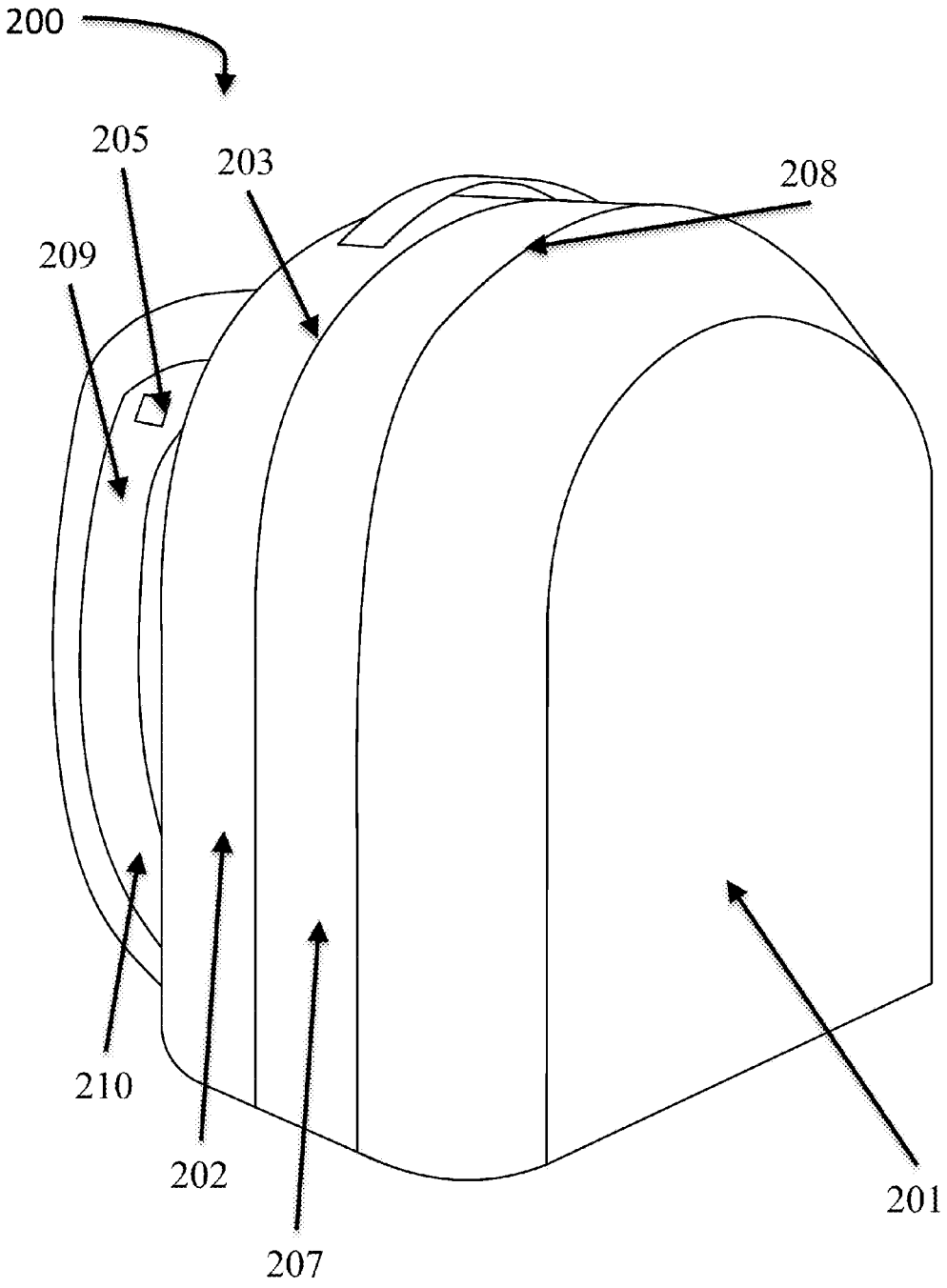
FIG. 2B is a schematic diagram of an embodiment of the disclosed system.
Figure 2C:
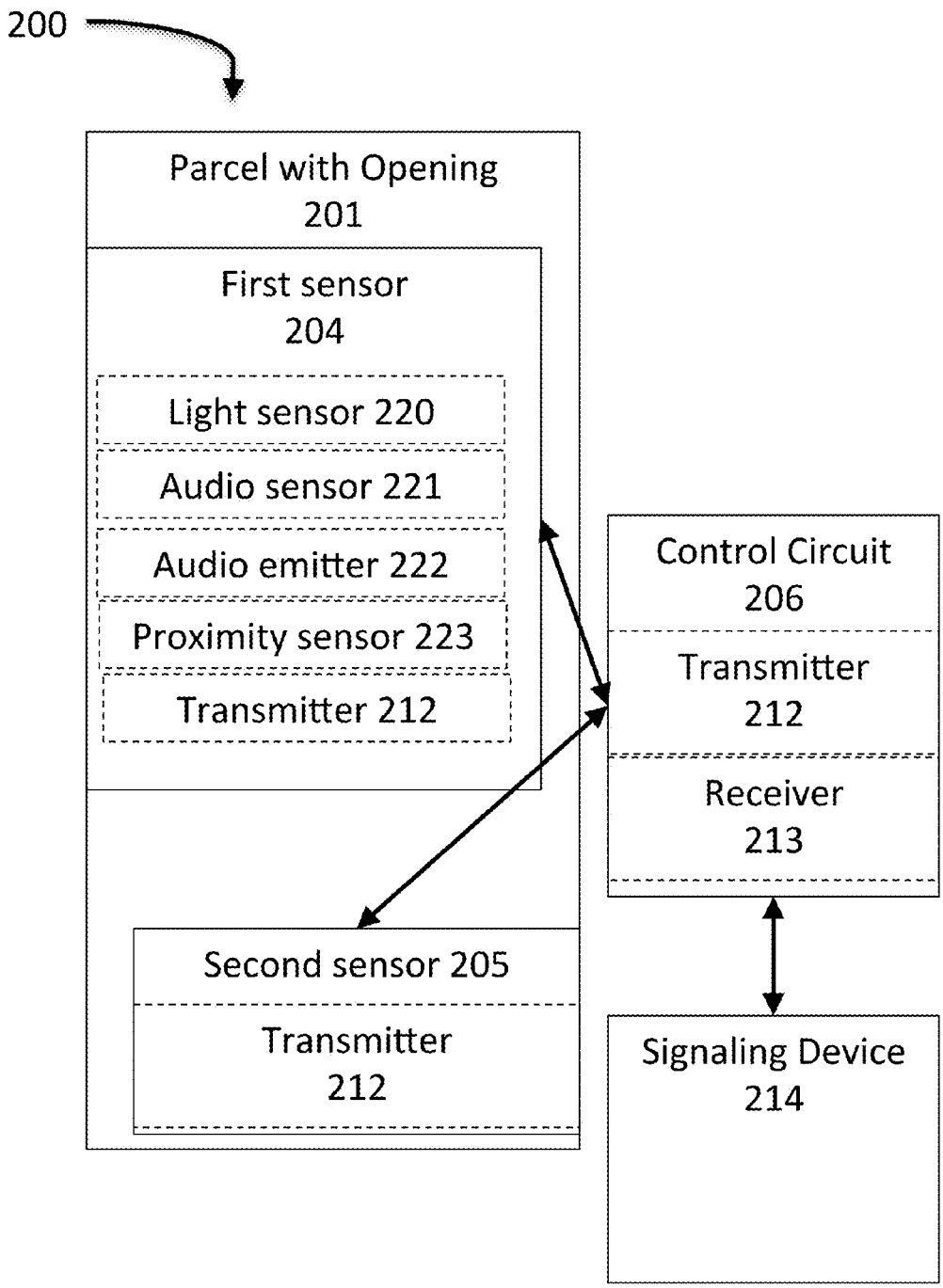
FIG. 2C is a block diagram of an embodiment of the disclosed system.

FIGS. 2A-C illustrate an embodiment of a system 200 for detecting that an open bag is being carried. As an overview, the system 200 includes a portable container 201. The portable container has a first compartment 202. The first compartment 202 has a first opening 203. The first opening 203 is mutable between an open state and a closed state. The system 200 includes at least one first sensor 204 incorporated in the portable container 201, the at least one first sensor configured to detect that the first opening 203 is in the open state. The system 200 includes at least one second sensor 205 incorporated in the portable container 201, the at least one second sensor configured to detect that the portable container 201 is being carried. The system 200 includes a control circuit 206 coupled to the at least one first sensor 204 and at least one second sensor 205, the control circuit 206 configured to transmit an alert to a user when the at least one first sensor 204 detects that the first opening 203 is in the open state and the at least one second sensor 205 detects that the portable container 201 is being carried.

Referring to FIG. 2A in further detail, the system 200 includes a portable container 201. In some embodiments, the portable container 201 is a container that can be moved about by or on a person. The portable container 201 may include a bag. The portable container 201 may include luggage, such as a suitcase, duffel bag, carry-on bag, or similar item. The portable container 201 may include a briefcase, a backpack, a purse, a carryall, or any similar hand-held device. The owner of the portable container 201 may be carrying it wheeling it, dragging it, or riding with it next to the owner on a seat or in a storage area. The owner of the portable container 201 may be walking or riding on a bicycle, wheelchair, scooter, car, train, bus, airplane, or other vehicle for transporting people. The portable container 201 may be constructed of any material or combination of materials suitable for the construction of a portable container, including substantially rigid materials, such as substantially rigid natural or synthetic polymers, metal, wood, or fiberglass, and substantially flexible materials such as textiles, leather, or substantially flexible natural or synthetic polymers.

The portable container 201 may have a first compartment 202 with a first opening 203. The first opening 203 may be mutable between an open state, for instance as shown in FIG. 2A, and a closed state, for example as shown in FIG. 2B. One or more fasteners may secure the first opening 203 in the closed state. The one or more fasteners may include any fastener suitable for fastening one surface to another. The one or more fasteners may include without limitation one or more slide fasteners, such as zippers, one or more hook-and-loop fasteners, one or more buckles such as a slide-release buckles, tension locks, or frame buckles, one or more snaps, one or more buttons, one or more magnets, or one or more ties.

The at least one first sensor 204 is incorporated in the portable container 201. In some embodiments, the at least one first sensor 204 is incorporated in the portable container 201 if the at least one first sensor 204 is attached to the portable container 201. The at least one first sensor 204 may be attached anywhere on the portable container 201. The manner of incorporation in the portable container 201 may depend on the sensors that the at least one first sensor 204 includes. For instance, in some embodiments, the at least one first sensor 204 includes a light sensor 220. The light sensor 220 may be any sensor that converts electromagnetic radiation to an electric signal; the electric signal may be a voltage or current signal. In some embodiments, the light sensor 220 is sensitive to electromagnetic radiation substantially within the spectrum visible to human beings; that is, the light sensor 220 may produce an electric signal when exposed to light that a typical person is capable of perceiving visually, while not producing a signal when exposed only to light that is significantly outside of that range, such as light having frequencies in the ultraviolet range or higher and light having frequencies in the infrared range or lower. The light sensor 220 may be sensitive to wavelengths above or below the human visual range as well. In some embodiments, the light sensor 220 is deployed within the first compartment 202. Disposal within the first compartment 202 may ensure that the light sensor detects an increase in light when the compartment is open in a place that has ambient or direct light; the first compartment 202 may be opaque to the wavelengths detectable by the light sensor, meaning that when the first opening 203 is closed, the light sensor 220 is sending a detectably lower electrical signal than when the first opening 203 is opened.

In some embodiments, the light sensor 220 is disposed adjacent to the first opening, for instance as shown for the at least one first sensor 204 in FIG. 2A. The light sensor may be disposed adjacent to the opening 203 when the light sensor is close enough to the opening 203 that visible light can pass from the opening 203 to the light sensor 220 unless the compartment 202 is substantially completely full; for instance, where the portable container 201 has a top, and the first opening 203 is near to the top of the portable container 201, the light sensor may be disposed near the top of the portable container 201 as well.

Figure 1B:
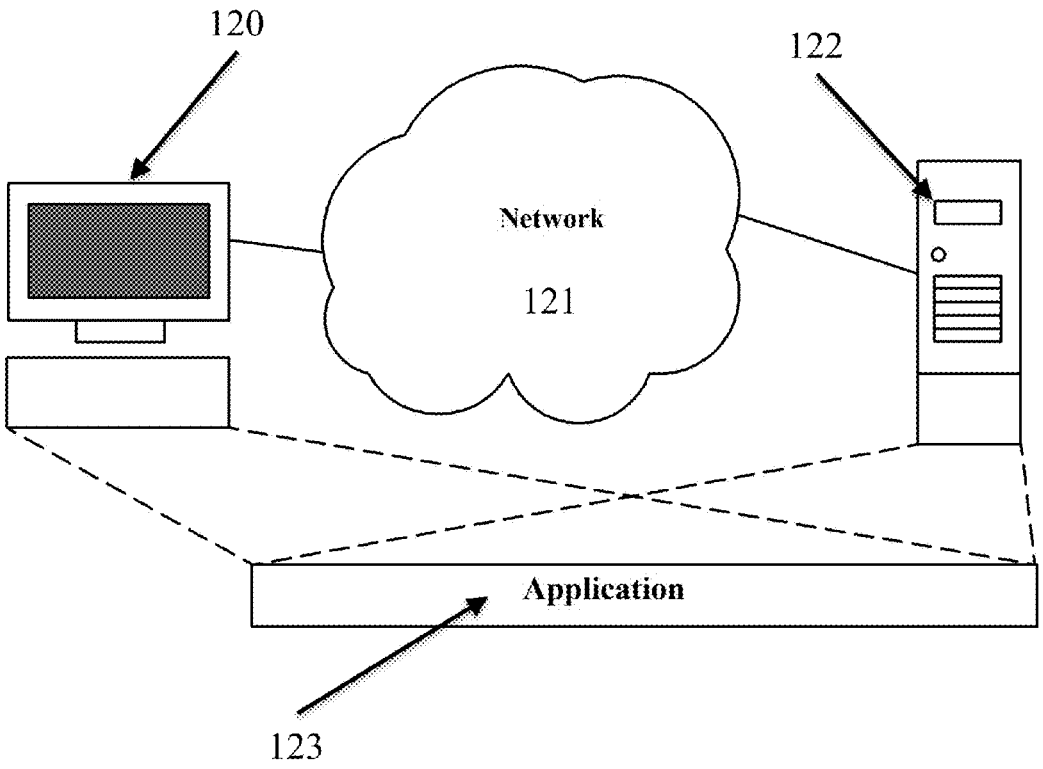
FIG. 1B is a block diagram of a network-based platform, as disclosed herein.
Figure 3:
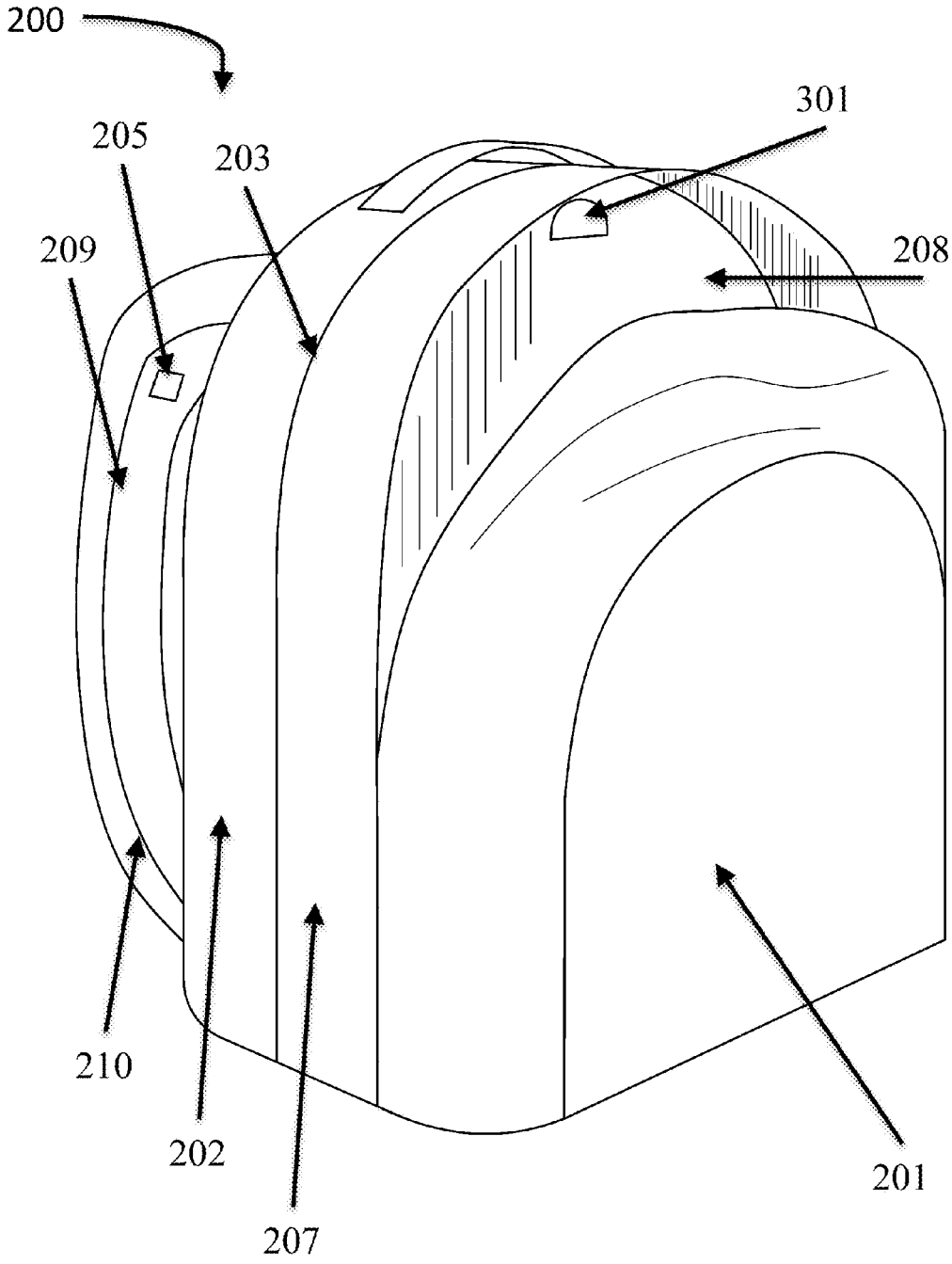
FIG. 3 is a schematic diagram of an embodiment of the disclosed system.

In some embodiments, the portable container 201 also has a second compartment 207. For instance, where the portable container 201 is a backpack, the portable container 201 may have a first compartment 202 next to the surface that rests against the user's back when the user is wearing the backpack in the typical manner, and a second compartment 207 adjacent to the first compartment 202. Similarly, where the portable container 201 is a handbag, suitcase, satchel, or other portable container 201 as described above, the portable container 201 may include one or more compartments, some of which may be adjacent to the first compartment 202. The second compartment 207 may included a second opening 208; the second opening 208 may be mutable between an open state, as shown in FIG. 3, and a closed state, as shown in FIGS. 1A-B. The second opening 208 may be any opening suitable for use as the first opening 203 as described above in reference to FIGS. 1A-C. In some embodiments, the first sensor 204 includes a second light sensor disposed within the second compartment 207; the light sensor within the second compartment 207 may detect an increase in light when the second opening 208 is open; this may be implemented as described above for the first opening 203 in reference to FIGS. 1A-C. In other embodiments, as shown for instance in FIG. 3, the second compartment 207 includes a window 301 that permits light that enters the second compartment to enter the first compartment; as a result, when the second opening 208 is open, the light sensor disposed within the first compartment 202 may detect the light entering the second compartment 207, causing the light sensor to send a signal even if the first compartment 202 is closed. The window 301 may be constructed of any material sufficiently translucent to a wavelength detectable by the light sensor to cause the light sensor to detect that the second opening 208 is open, including without limitation clear or translucent polymer materials, glass, or crystal. The window 301 may be an opening between the first compartment 301 and second compartment 207; that is, there may be no material in the window 301 at all. The translucent or transparent material making up the window 301, where present, may be attached to the opening by any suitable means including without limitation adhesion, press fitting, sewing, and heat-sealing.

In other embodiments, the at least one first sensor 204 includes other sensors. The first sensor 204 may include an audio sensor 221; the audio sensor 221 may detect sound or other vibrations including one or more audio frequencies and produce a resulting electrical signal, for instance in the manner used by a microphone. The detected audio frequency may be within the audible range for a typical person. In other embodiments, the detected audio frequency may have a lower frequency than the audible range of a typical person. In other embodiments, the detected audio frequency has a higher frequency than the audible range for a typical person; the detected audio frequency may be ultrasonic. In some embodiments, the at least one first sensor 204 includes an audio emitter 222, which receives an electrical signal and produces an audio signal, for instance in the manner of an electrical speaker. The audio emitter 222 may emit any frequency detectable by the audio sensor 221; for instance, the at least one first sensor 204 may include an ultrasonic audio emitter 222 and an ultrasonic audio sensor 221. In some embodiments, the audio sensor 221 can detect a first echo pattern corresponding to the compartment 202 with a closed first opening 203, and a second echo pattern corresponding to the compartment 202 with an open first opening 203. The control circuit 206 may be configured to detect the difference between a signal produced by the audio sensor 221 based on the first echo and a signal produced by the audio sensor 221 in response to the second echo.

Figure 4A:
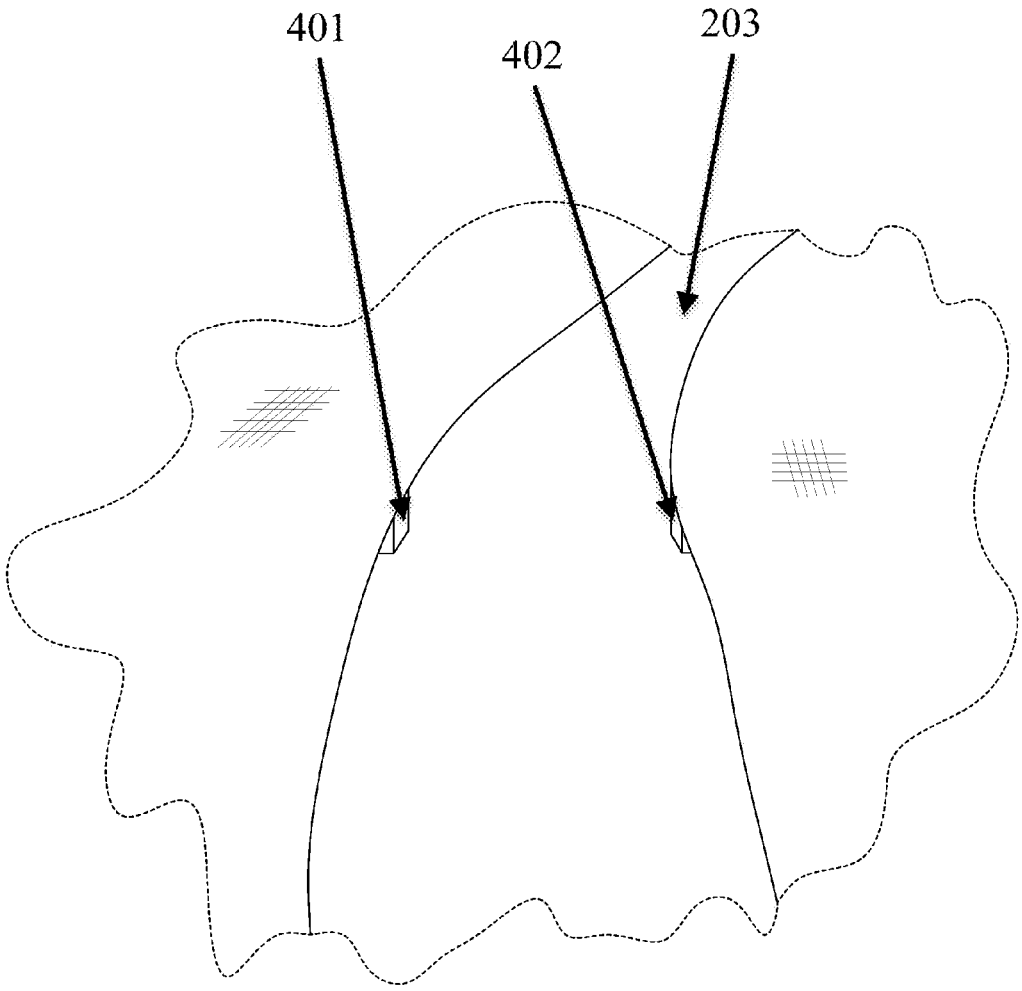
FIG. 4A is a schematic diagram of an embodiment of a portion of the disclosed system.
Figure 4B:
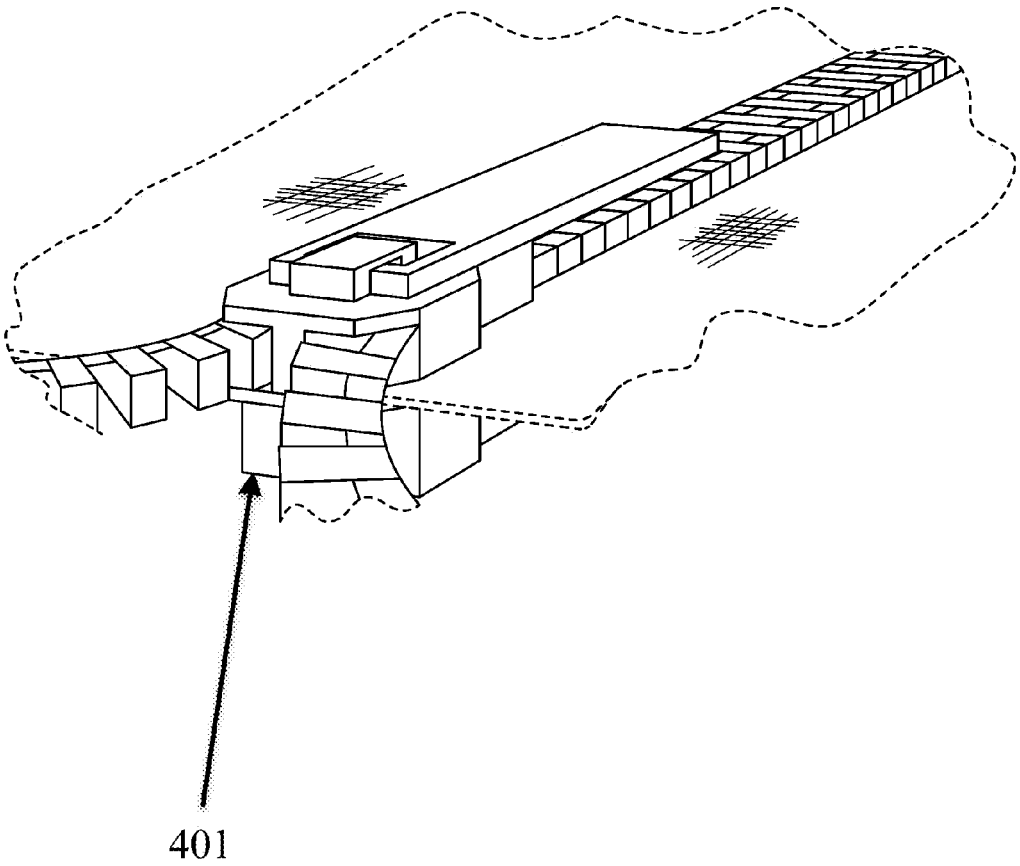
FIG. 4B is a schematic diagram of an embodiment of a portion of the disclosed system.

The at least one first sensor 204 may include a proximity sensor 223. For instance, as shown as FIG. 4A, the at least one first sensor 204 may include at least one proximity sensor 401 mounted on an edge of the first opening 203, the at least one proximity sensor configured to detect proximity of the sensor to an opposite edge of the first opening 203. The proximity sensor 401 may have an opposite component 402 on the opposite edge, the distance from which the proximity sensor 401 can sense. In another embodiment, for instance as shown in FIG. 4B, the proximity sensor 401 is mounted on one slider of a slide fastener, such as a zipper. The opposite member may be mounted on another slider, for instance as illustrated in FIG. 4B, if the slide fastener has two sliders. The opposite member may be mounted at any point along the edge of the first opening, including at one end of the slide fastener.

Returning to FIGS. 1A-C, the system 200 includes at least one second sensor 205 incorporated in the portable container 201, the at least one second sensor 205 configured to detect that the portable container 201 is being carried. In some embodiments, the at least one second sensor 205 includes a light sensor. The light sensor may be mounted on an exterior surface 209 of the portable container 201 that is typically covered when the portable container 201 is being carried; as a result, the light sensor may detect significantly less light when the container 201 is being carried. For instance, the exterior surface 209 may be a surface of a backpack or handbag that typically rests against the user's body when the backpack or handbag is being carried. As another example, where the container 201 includes a strap 210, the exterior surface 209 may be an underside of the strap 210, where the underside is the surface of the strap that contacts the person of the user when the portable container 201 is being carried; for instance, the strap 210 may be the shoulder strap of a backpack or handbag, and the underside of the strap 210 may be the surface of the shoulder strap that rests on the shoulder, chest, or back of the user when the backpack or handbag is being carried.

The at least one sensor 205 may include a motion sensor. The at least one motion sensor may include any sensor or combination of sensors by means of which the at control circuit 206 may be able to detect its own motion. The at least one motion sensor may include at least one accelerometer. In some embodiments, the at least one accelerometer includes two or more accelerometers; for example, the at least one accelerometer may include three accelerometers aligned to non-parallel axes (e.g., three mutually orthogonal accelerometers), coupled to the control circuit 206, enabling the control circuit 206 to determine the direction of acceleration of the motion sensor in three dimensional space. The at least one motion sensor may include at least one gyroscope. The at least one gyroscope may include two or more gyroscopes; for example, the at least one gyroscope may include three gyroscopes aligned to non-parallel axes (e.g., three mutually orthogonal gyroscopes), coupled to the control circuit 206, enabling the control circuit 206 to determine the direction of a change of pitch of the motion sensor in three dimensional space. The at least one motion sensor may include at least one magnetometer. The at least one magnetometer may include two or more magnetometers; for example, the at least one magnetometer may include three magnetometers aligned to non-parallel axes (e.g., three mutually orthogonal magnetometers), coupled to the control circuit 206, enabling the control circuit 206 to determine the a change of direction of the at least one motion sensor, relative to a magnetic field such as the magnetic field of the Earth, in three dimensional space. In some embodiments, the at least one motion sensor includes an inertial measurement unit (IMU) incorporating one or more accelerometers, gyroscopes, or magnetometers as described above; the IMU may also include a dedicated processor that interprets sensor input and renders it more easily usable for the control circuit 206.

The control circuit 206 may be any circuit that receives the input of the at least one first sensor 204 and the at least one second sensor 205 and transmits an alert to the user as when the at least one first sensor 204 detects that the first opening 203 is in the open state and the at least one second sensor 205 detects that the portable container 201 is being carried. In some embodiments, the control circuit 206 includes a processor, which may be any processor 101 as described above in reference to FIGS. 1A-B. For example, and without limitation, the processor 101 may be a microprocessor. The processor may be programmable; for instance, the processor may be coupled to memory, such as main memory 102 or secondary memory 103 as disclosed above in connection with FIGS. 1A-1B.

The control circuit 206 is coupled to the at least one first sensor 204 and the at least one second sensor 205. The control circuit 206 may be electrically coupled to the at least one first sensor 204 or the at least one second sensor 205; in other words, the control circuit 206 may be incorporated in an electronic circuit that includes the at least one first sensor 204, the at least one second sensor 205, or both. The control circuit 206 may be coupled to either the at least one first sensor 204 or the at least one second sensor 205 by a transmitter 212 and receiver 213 pair. Each transmitter 212 may be an electronic device that emits a signal using electromagnetic radiation; the radiation used may have any frequency used for communication between devices. The signal may be a radio frequency signal such as those used for radio frequency communication. The signal may be a microwave signal. The signal may be an infrared signal. The signal may use visible light. The signal may be analog; for instance, the signal may be frequency modulated or amplitude modulated. The signal may be digital. In some embodiments, the signal is constantly emitted. In other embodiments, the signal is intermittently or periodically emitted. The transmitter 212 may include an antenna (not shown).

In some embodiments, each transmitter 212 is configured to transmit a simple signal without any modification; for instance, the transmitter 212 may consist of hardwired circuitry that sends out a particular radio frequency signal without variation. In some embodiments, the transmitter 212 may be incorporated in a "system on a chip," combining several elements together in a small number of integrated circuits; for instance, the at least one transmitter 212 may have a single integrated circuit including a processor, transceiver, and memory. The processor may be a computing device 100 as described above in reference to FIGS. 1A-1B; for instance, the at least one transmitter 212 may include a mobile device such as a smartphone or a special-purpose computing device created for use in the disclosed system and method. The at least one transmitter 212 may include a near-field communication device, such as those using the BLUETOOTH protocol promulgated by Bluetooth SIG, Inc. of Kirkland, Wash.

In some embodiments, the control circuit 206 includes a receiver 213. The receiver 213 may be a device that senses electromagnetic radiation emitted by a transmitter 212 and converts the received radiation into an electronic signal in the control circuit 206. In some embodiments, the control circuit 206 includes a transceiver; that is, the transmitter 212 and receiver 213 of the control circuit 206 may be combined in a single device. The at least one first sensor 204 or at least one second sensor 205 may also include transceivers or receivers. In some embodiments, the transceiver coupled to the control device 206 is configured to convey the alert to a computing device. The computing device may be used by the user; for instance, the computing device may be a mobile device such as a smartphone or tablet on the user's person. In other embodiments, the control circuit 206 is a mobile device programmed to communicate with the at least one first sensor 204 and at least one second sensor 205, for instance using transmitter-receiver pairs.

The system 200 may include at least one signaling device 214 coupled to the control circuit 206. The at least one signaling device 214 may be any device by means of which the control circuit 206 can alert a user as set forth in further detail below in reference to FIG. 5. The at least one signaling device 214 may include an audio signaling device, such as a speaker, which emits an audible noise when activated. The at least one signaling device 214 may include a light-emitting device, such as a light, or a display 110 as described above in connection with FIGS. 1A-B. The at least one signaling device 214 may include a haptic device, such as a vibrator. The at least one signaling device 214 may combine a plurality of different signaling devices; for instance, the at least one signaling device 214 may include both an audio signaling device and a light-emitting device. Where the control circuit 206 is or communicates with a mobile device, the at least one signaling device 214 may include one or more of the signaling devices incorporated in the mobile device 214, such as built-in speakers, vibrators, and the display.

Figure 5:
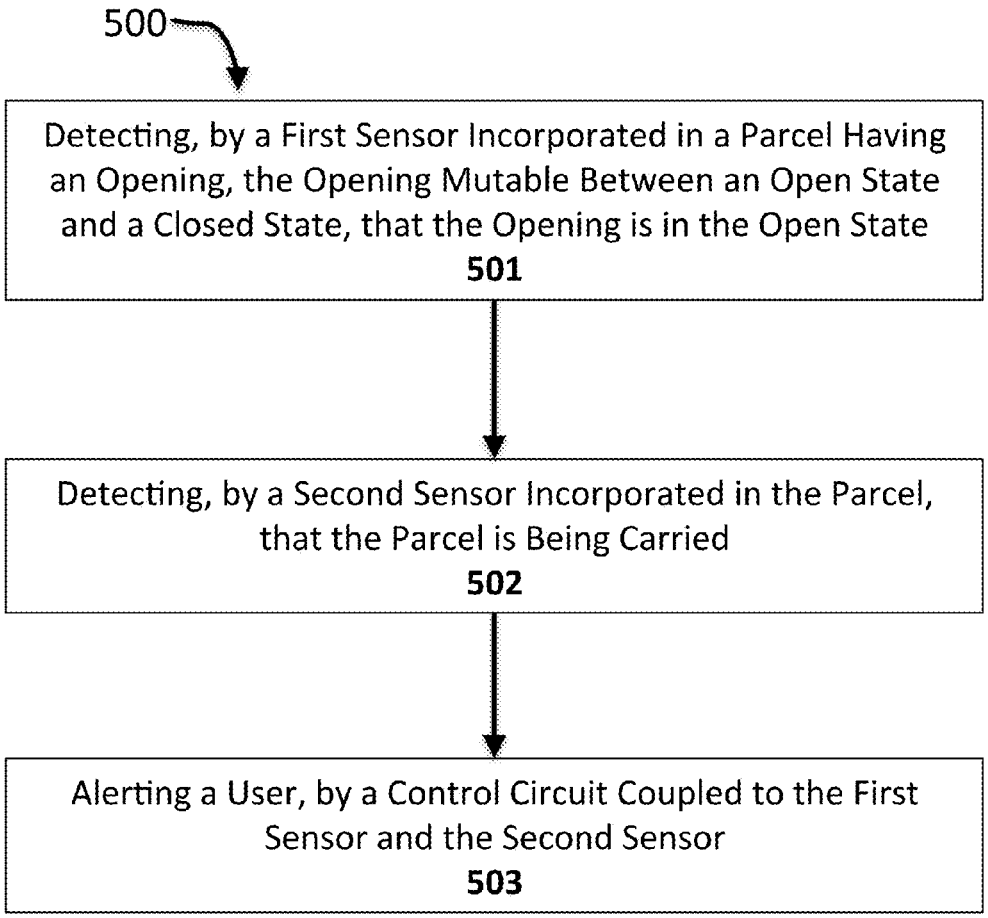
FIG. 5 is a flow diagram illustrating one embodiment of the disclosed method.

FIG. 5 illustrates some embodiments of a method 500 for reminding a user to close a bag. The method 500 includes detecting, by a first sensor incorporated in a portable container having an opening, the opening mutable between an open state and a closed state, that the opening is in the open state (501). The method 500 includes detecting, by a second sensor incorporated in the portable container, that the portable container is being carried (502). The method 500 includes alerting a user, by a control circuit coupled to the first sensor and the second sensor (503).

Referring to FIG. 5 in greater detail, and by reference to FIGS. 2A-4, the first sensor 204 detects that the opening is in the open state (501). The first sensor 204 may detect a change in light levels, where the first sensor 204 includes a light sensor; for instance the first sensor 204 may detect that the opening 203 is in the open state by sensing an increase in light from the opening, as described above in reference to FIGS. 1A-4. Where the first sensor 204 includes a proximity sensor, the first sensor 204 may detect that the opening 203 is open by detecting that two opposite edges of the opening have become more distant from each other.

The second sensor 205 detects that the portable container 201 is being carried (502). The second sensor 205 may detect a change in light levels; for instance, the second sensor 205 may detect a reduction in light because the user is wearing the portable device 201, for example because the second sensor 205 includes a light sensor on an exterior surface typically covered when the portable container 201 is being carried. In other embodiments, where the second sensor 205 includes a motion sensor, the second sensor 205 detects one or more movements consistent with the portable container 201 being carried, such as a vertical acceleration followed by steady movement in a horizontal direction.

The control circuit 206 alerts a user (503). In some embodiments, the control circuit switches on a signaling device when the control circuit 206 receives signals from the first and second sensors. In some embodiments, the control circuit is programmed to compare the signal or signals from the first sensor 204 and second sensor 205 to a pattern consistent with the portable container 201 being carried while open. For instance, the control circuit 206 may compare a signal from a light sensor 204 within the compartment 202 to a threshold level corresponding to a level of light intensity within the compartment 202 that is consistent with the opening 203 being open. Likewise, the control circuit 206 may compare a signal corresponding to a light level from a light sensor 205 on the exterior of the portable container 201 to another threshold consistent with the light sensor 205 being blocked because the user is carrying the portable container 201. The control circuit 206 may receive from a proximity sensor 401 a signal indicating a certain degree of distance between one edge and another edge of the opening 203; the control circuit 206 may compare that signal to another threshold number. The control circuit 206 may compare one or more movements detected by at least one movement sensor to a pattern of movements that indicate the portable container 201 is being carried, and determine that the patterns match. In some embodiments, the control circuit 206 combines determination concerning the input from the first sensor 204 and the input from the second sensor 205 to determine that the portable container 201 is being carried and the first opening 203 is open.

The control circuit 206 may alert the user by means of a signaling device 214. For instance, the control circuit 206 may cause a light to shine or flash intermittently. The control circuit 206 may cause a display to display a message or symbol. The control circuit 206 may cause an audio signaling device to emit an audio signal. The audio signal may include, without limitation, a buzz or chime, a ringtone, any recorded or sampled sound, or a verbal message. The control circuit 206 may cause the signaling device 214 to emit a haptic signal such as vibration. The control signal 206 may transmit, to a mobile device used by the user, a message; the message may be textual, an image, or an audio message to be emitted by the mobile device. The control circuit 206 may perform any combination of the above-described alerts; for instance, the control circuit 206 may cause a light to flash or an audio signal device to emit a buzzing noise, or the control circuit 206 may transmit a message to the mobile device that emits an audio alarm while displaying a text message.

Although the foregoing systems and methods have been described in some detail for purposes of clarity of understanding, it will be apparent that certain changes and modifications may be practiced within the scope of the appended claims.

What is claimed is:

1. A system for detecting that an open bag is being carried, the system comprising:

a portable container having a first compartment with a first opening, the first opening mutable between an open state and a closed state;

at least one first sensor incorporated in the portable container, the at least one first sensor configured to detect that the first opening is in the open state;

at least one second sensor incorporated in the portable container, the at least one second sensor configured to detect that the portable container is being carried;

a control circuit coupled to the at least one first sensor and at least one second sensor, and at least one signaling device selected from the group comprising of an audio signaling device, a light-emitting device, and a haptic device, wherein said signaling device is coupled to the control circuit such that the control circuit, by means of the signaling device can transmit an alert to a user when the at least one first sensor detects that the first opening is in the open state and the at least one second sensor detects that the portable container is being carried.

2. The system of claim 1, wherein the at least one first sensor further comprises a light sensor disposed within the first compartment.

3. The system of claim 2, wherein the light sensor is disposed adjacent to the first opening.

4. The system of claim 3, wherein the portable container further comprises a second compartment.

5. The system of claim 4, wherein the at least one first sensor further comprises a light sensor deployed within the second compartment.

6. The system of claim 4 further comprising a window that permits light that enters the second compartment to enter the first compartment.

7. The system of claim 1, wherein the at least one first sensor further comprises at least one proximity sensor mounted on an edge of the opening, the at least one proximity sensor configured to detect proximity of the sensor to an opposite edge of the opening.

8. The system of claim 1, wherein the at least one first sensor further comprises an audio sensor, that can detect one or more audio frequencies and produce a resulting electrical signal, and an audio emitter, that can receive an electrical signal and produce an audio signal of one or more audio frequencies.

9. The system of claim 1, wherein the at least one second sensor further comprises a light sensor.

10. The system of claim 9, wherein the light sensor is mounted on an exterior surface of the portable container that is typically covered when the portable container is being carried.

11. The system of claim 10, wherein the exterior surface is an underside of a strap.

12. The system of claim 1, wherein the at least one second sensor further comprises a motion sensor.

13. The system of claim 1, wherein the control circuit further comprises a processor.

14. The system of claim 1, wherein the control circuit is electrically coupled to at least one of the at least one first sensor and the at least one second sensor.

15. The system of claim 1, wherein the control circuit is coupled to at least one of the at least one first sensor and the at least one second sensor by a transmitter-receiver pair.

16. The system of claim 1 further comprising a transceiver coupled to the control circuit, the transceiver configured to convey the alert to a computing device.

17. A method for reminding a user to close a bag, the method comprising:

detecting, by a first sensor incorporated in a portable container having an opening, the opening mutable between an open state and a closed state, that the opening is in the open state;

detecting, by a second sensor incorporated in the portable container, that the portable container is being carried; and alerting a user, by a control circuit coupled to the first sensor and the second sensor and to at least one signaling device selected from the group comprising of an audio signaling device, a light-emitting device, and a haptic device, wherein said control circuit, by means of the signaling device can transmit one or more of an audio, light, or haptic alert to a user when the first sensor detects that the opening is in the open state and the second sensor detects that the portable container is being carried.

18. The method of claim 17, wherein alerting further comprises transmitting, to a mobile device used by the user, a message.

* * * * *